US008356734B2

(12) United States Patent
Oshimo et al.

(10) Patent No.: US 8,356,734 B2
(45) Date of Patent: Jan. 22, 2013

(54) TRIGGER TYPE HEAD CAP FOR AN AEROSOL SPRAYER

(75) Inventors: Toshiaki Oshimo, Hiroshima (JP); Hideo Kawamori, Hatsukaichi (JP); Kazunori Yamamoto, Hatsukaichi (JP)

(73) Assignee: Fumakilla Limited, Tokyo (JP)

( * ) Notice: Subject to any disclaimer, the term of this patent is extended or adjusted under 35 U.S.C. 154(b) by 708 days.

(21) Appl. No.: 12/523,198

(22) PCT Filed: Dec. 12, 2007

(86) PCT No.: PCT/JP2007/074346

§ 371 (c)(1),
(2), (4) Date: Jul. 15, 2009

(87) PCT Pub. No.: WO2008/087826

PCT Pub. Date: Jul. 24, 2008

(65) Prior Publication Data

US 2010/0025437 A1 Feb. 4, 2010

(30) Foreign Application Priority Data

Jan. 19, 2007 (JP) ..... 2007-010074

(51) Int. Cl.
*B65D 83/00* (2006.01)
*B67B 1/00* (2006.01)

(52) U.S. Cl. ..... 222/402.13; 222/397; 222/402.15; 222/153.11

(58) Field of Classification Search ..... 222/402.13, 222/402.14, 402.15, 402.23, 402.1, 153.11, 222/153.12, 153.1, 397, 399
See application file for complete search history.

(56) References Cited

U.S. PATENT DOCUMENTS

| | | | | | |
|---|---|---|---|---|---|
| 3,143,254 | A | * | 8/1964 | Vanderhyde | 222/402.11 |
| 3,189,232 | A | * | 6/1965 | Joffe | 222/402.13 |
| 3,506,159 | A | * | 4/1970 | Muller | 222/135 |
| 3,534,889 | A | * | 10/1970 | O'Donnell | 222/402.13 |
| 4,449,647 | A | * | 5/1984 | Reed et al. | 222/153.09 |
| 5,154,323 | A | * | 10/1992 | Query et al. | 222/153.11 |
| 5,624,055 | A | * | 4/1997 | Clanet et al. | 222/135 |

FOREIGN PATENT DOCUMENTS

| | | | |
|---|---|---|---|
| JP | 2002-166982 | A | 6/2002 |
| JP | 2006-044705 | A | 2/2006 |
| JP | 2006-347628 | A | 12/2006 |

OTHER PUBLICATIONS

International Preliminary Report on Patentability and Written Opinion of the International Searching Authority dated Jul. 21, 2009 (5 pages), issued in counterpart International application No. PCT/JP2007/074346.

* cited by examiner

*Primary Examiner* — Kevin P Shaver
*Assistant Examiner* — Stephanie E Williams
(74) *Attorney, Agent, or Firm* — Holtz, Holtz, Goodman & Chick, PC

(57) ABSTRACT

A trigger type head cap for an aerosol sprayer allows residual gas inside of an aerosol container of the sprayer to be easily and reliably discharged and eliminated. The cap includes a cap cover to be placed on the aerosol container, which has a stem provided on a top thereof; a tubular member that has a stem mating part to mate with the stem and ends with a jet orifice to form a flow path continuous from the stem mating part to the jet orifice in the tubular member; and a trigger lever member capable of thrusting down the stem mating part. In addition, the cap has a rotatable rotary stopper (21) to hold the stem mating part in the state that it is thrust down, and a stopper operating lever for effecting rotation of the stopper.

9 Claims, 8 Drawing Sheets

TRIGGER TYPE HEAD CAP FOR AN AEROSOL SPRAYER

This application is a U.S. National Phase Application under 35 USC 371 of International Application PCT/JP2007/074346 filed Dec. 12, 2007.

TECHNICAL FIELD

The present invention relates to a trigger type head cap for an aerosol sprayer and, more particularly, to a trigger type head cap for an aerosol sprayer, which when an entire content accommodated in an aerosol container in the aerosol sprayer has been sprayed out and used up (at the end of use of the aerosol container) is capable of discharging and eliminating a residual gas that remains inside of the aerosol container.

BACKGROUND ART

An aerosol sprayer has been known which comprises a can-like aerosol container accommodating its content such as a chemical in its inside and a trigger type head cap fitted on the aerosol container.

The aerosol container accommodating its content such as a chemical in its inside is filled with a gas sealed up therein, and accommodates such contents as the chemical, being internally pressurized with the gas. And, it is equipped on its top with a stem normally biased upwards, which when pushed down allows the contents of the aerosol container to be sprayed out under the internal pressure.

On the other hand, the trigger type head cap has a cap cover fitted on the aerosol container and the cap cover has a tubular member formed with a stem mating part mating with the stem on the aerosol container, the tubular member ending with a jet orifice to form a flow path continuous from the stem mating part to the jet orifice in the tubular member. The head cap further has a trigger lever member capable of thrusting down the stem mating part of the tubular member in the cap cover.

In such makeup, pulling a trigger part of the trigger lever member causes the tubular member and its stem mating part to be thrust down. This causes the stem to be thrust down on the aerosol container, allowing the content of the aerosol container in its inside to spurt out of the stem, to pass through the flow path in the tubular member in the trigger type head cap and to be sprayed out of the jet orifice.

In such an aerosol sprayer, when an entire content accommodated inside of the aerosol container has been sprayed and used up (at an end of the use of an aerosol container), there is often the case that gas remains in the aerosol container, so that the container when disposed as a waste may have a danger of explosion accident due to the gas remaining in the container, that is the residual gas.

In order to get rid of such an explosion accident due to the residual gas, there is, for example, an aerosol sprayer what is described in JP 2006-44705 A. This has a generally cylindrical slide stopper adapted to slide back and forth on the tubular member in a region of the end of the tubular member such that when the trigger lever member is operated for spraying, the slide stopper is caused to slide forth to enter a gap formed between the trigger lever member and the tubular member and to fit in the gap whereby the trigger lever member is locked coming to hold the spraying state and thereby to discharge and eliminate the residual gas in the aerosol container.

In such an aerosol sprayer in the prior art in which to discharge and eliminate a residual gas in an aerosol container a slide stopper adapted to slide on a tubular member which is used when a trigger lever member is operated, is caused to slide forward and to enter a gap formed between the trigger lever member and the tubular member and fit in the gap, there is the possibility that the slide stopper when acted to fit in may hit against the trigger lever member and fail to fit in the gap snugly, unless the trigger lever member is acted correctly and yet hard to make the gap between the trigger lever and the tubular member left large. It is difficult to understand the operating method and very complicated to act on. Moreover, where in working to fit the slide stopper in, it is slid forwards it must then be much forced to slide. It is, here again, complicated to act on.

In light of such problems as complicacy in working to discharge and eliminate a residual gas in an aerosol container, it is an object of the present invention to provide a trigger type head cap for an aerosol sprayer, which can be worked easily and reliably.

DISCLOSURE OF THE INVENTION

A first of the present invention is a trigger type head cap for an aerosol sprayer, which comprises a cap cover being fitted on an aerosol container, the aerosol container having a stem provided on a top thereof; a tubular member formed with a stem mating part mating with the stem on the aerosol container in the cap cover, and ending with a jet orifice to form a flow path continuous from the stem mating part to the jet orifice in the tubular member; and a trigger lever member capable of thrusting down the stem mating part of the tubular member in the cap cover, wherein there is included a rotatable rotary stopper capable of holding the stem mating part of the tubular member in the state that it is thrust down.

A second of the present invention is a trigger type head cap for an aerosol sprayer according to the first invention, wherein there is included on a side surface of the cap cover a stopper operating lever for effecting a rotation of the rotary stopper.

A third of the present invention is a trigger type head cap for an aerosol sprayer according to the second invention, wherein the stopper operating lever is included that is positioned on the cap cover at an opposite side of a trigger part of the trigger lever member so that the stopper operating lever and the trigger part of the trigger lever member are spaced away from each other.

According to the present invention in which there is included a rotatable rotary stopper capable of holding the stem mating part of the tubular member in the state that it is thrust down, in an operation to discharge and eliminate a residual gas inside of an aerosol container in the aerosol sprayer it is possible to accomplish discharging and eliminating the residual gas in an extremely simple and plain operation that is merely by rotation of the rotary stopper, thereby effecting the operation easily and yet reliably and safely.

Also, according to the present invention in which there is included on a side surface of the cap cover a stopper operating lever for effecting a rotation of the rotary stopper, the rotation of the rotary stopper can be effected in an extremely simple and plain operation that is merely by turning the stopper operating lever, thereby discharging and eliminating the residual gas with extreme ease.

Further, according to the present invention in which the stopper operating lever is included that is positioned on the cap cover at an opposite side of a trigger part of the trigger lever member so that the stopper operating lever and the trigger part of the trigger lever member are spaced away from each other, the stopper operating lever when the trigger part of the trigger operating lever is pulled to effect a normal spraying can be prevented from being operated in error, thereby eliminating the problem that an entire content inside of the aerosol container may then be wrongly sprayed out.

BEST MODES FOR CARRYING OUT THE INVENTION

Explanation is given of a trigger type head cap for an aerosol sprayer according to the present invention with respect to a form of implementation thereof.

Figure 1:
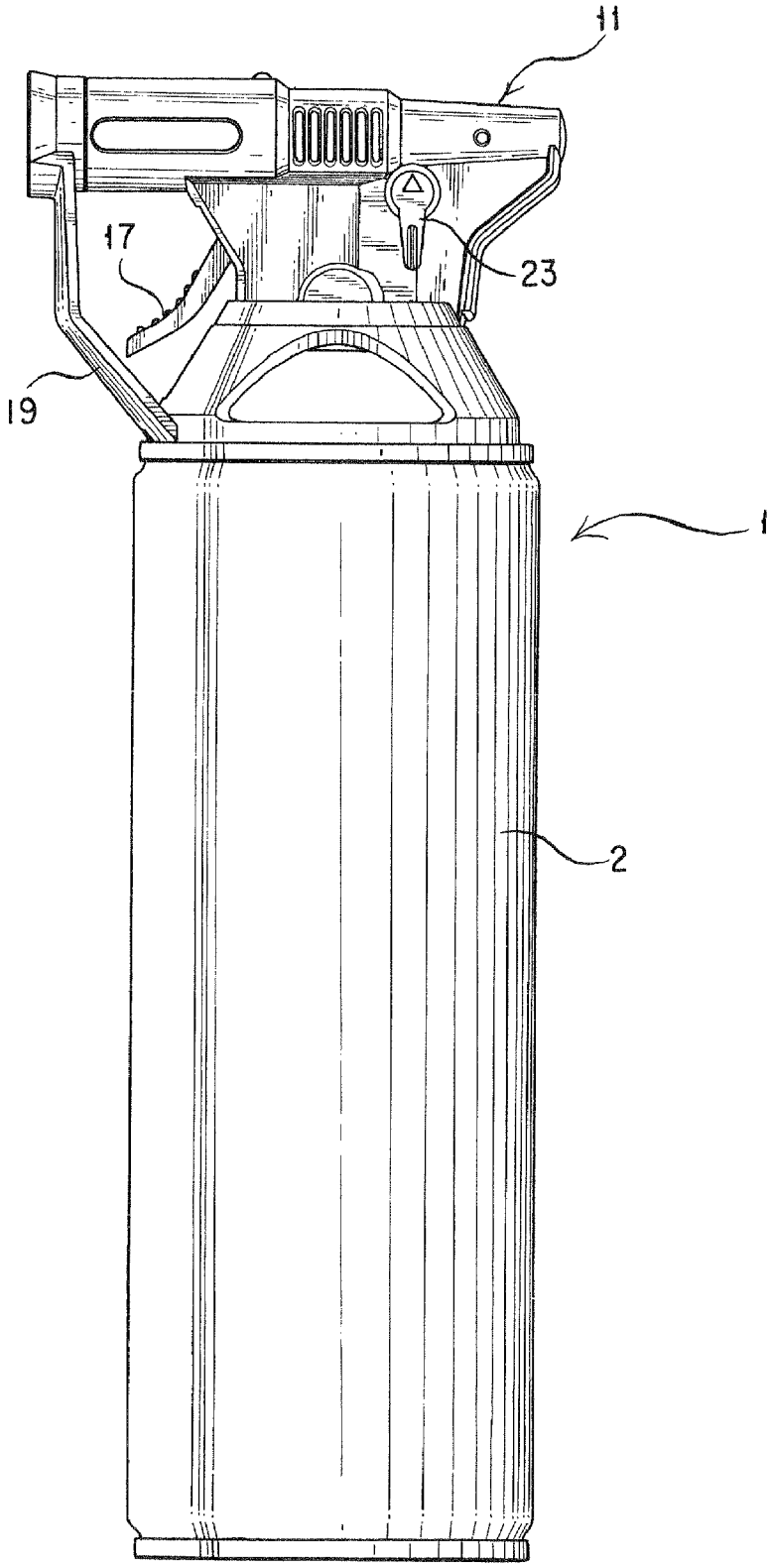
FIG. 1 is an explanatory view of an aerosol sprayer.

First, as shown in FIG. 1 an aerosol sprayer 1 as in the prior art takes its makeup that it is equipped with a can-like aerosol container 2 and has a trigger type head cap fitted on a top of the aerosol container 2. The aerosol container 2 accommodates as its content any of chemicals such as an insecticide, insect pest control, repellent and antibacterial and antifungal agent, chemicals such as detergent, deodorant, aromatic substance and antiperspirant, and paints. And, the container 2 is filled with a gas sealed up therein, and accommodates such content as the chemical, being internally pressurized with the gas. And, the aerosol container 2 is equipped on its top with a stem 4 normally biased upwards, which when thrust down allows the contents of the aerosol container 2 to be sprayed out under its internal pressure.

Figure 2:
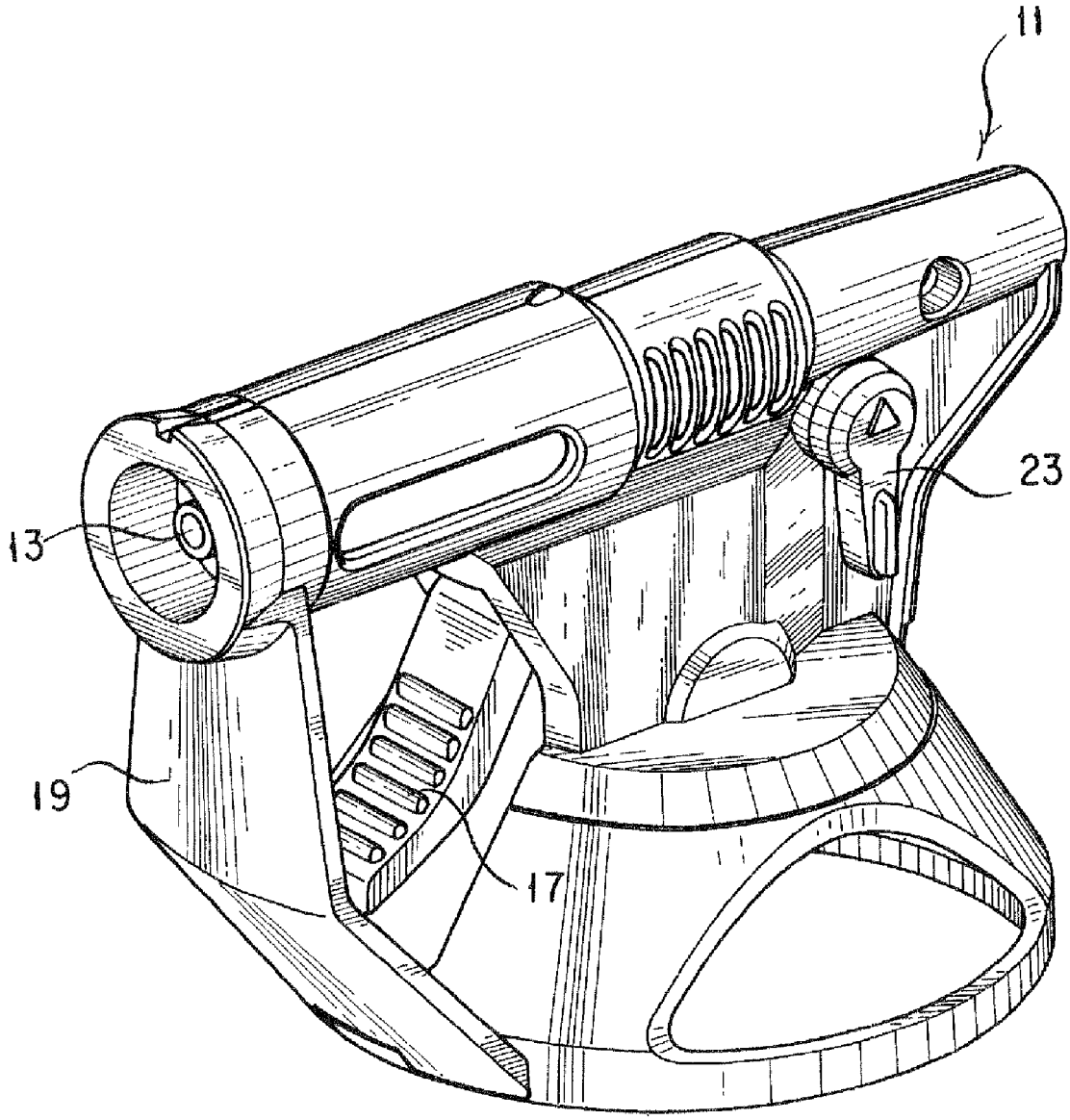
FIG. 2 is a perspective view of a trigger type head cap for the aerosol sprayer.
Figure 3:
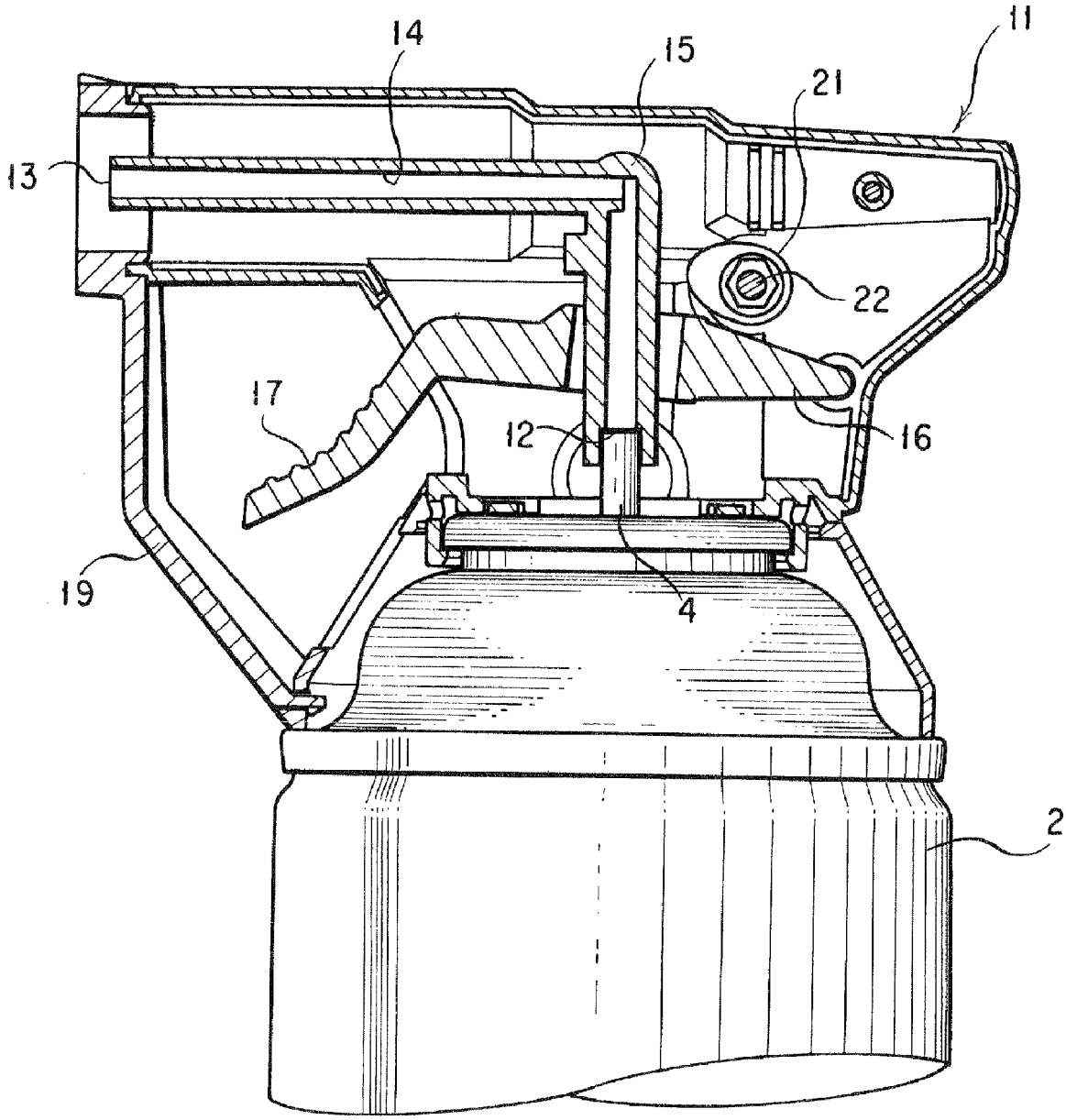
FIG. 3 is a cross sectional view of the trigger type head cap for the aerosol sprayer.

Next, as shown in FIGS. 2 and 3 the trigger type head cap has a cap cover 11 fitted on the aerosol container 2. The cap cover 11 has an upper portion made cylindrical as oriented back and forth and a lower portion made in the form of a generally cylindrical frustum of cone as oriented up and down. And, the cap cover 11 has in its inside a L-shaped tubular member 15 formed with a stem mating part 12 mating with the stem 4, and ending with a jet orifice 13 to form a flow path 14 continuous from the stem mating part 12 to the jet orifice 13 in the tubular member 15. It also has in its inside, a vertically turnable trigger lever member 16 capable of thrusting down the stem mating part 12 of the tubular member 15, wherein the trigger lever member 16 has a forward end portion bent downwards to form a trigger part 17 and a mid portion formed with a hole through which the tubular member 15 passes vertically.

Figure 4:
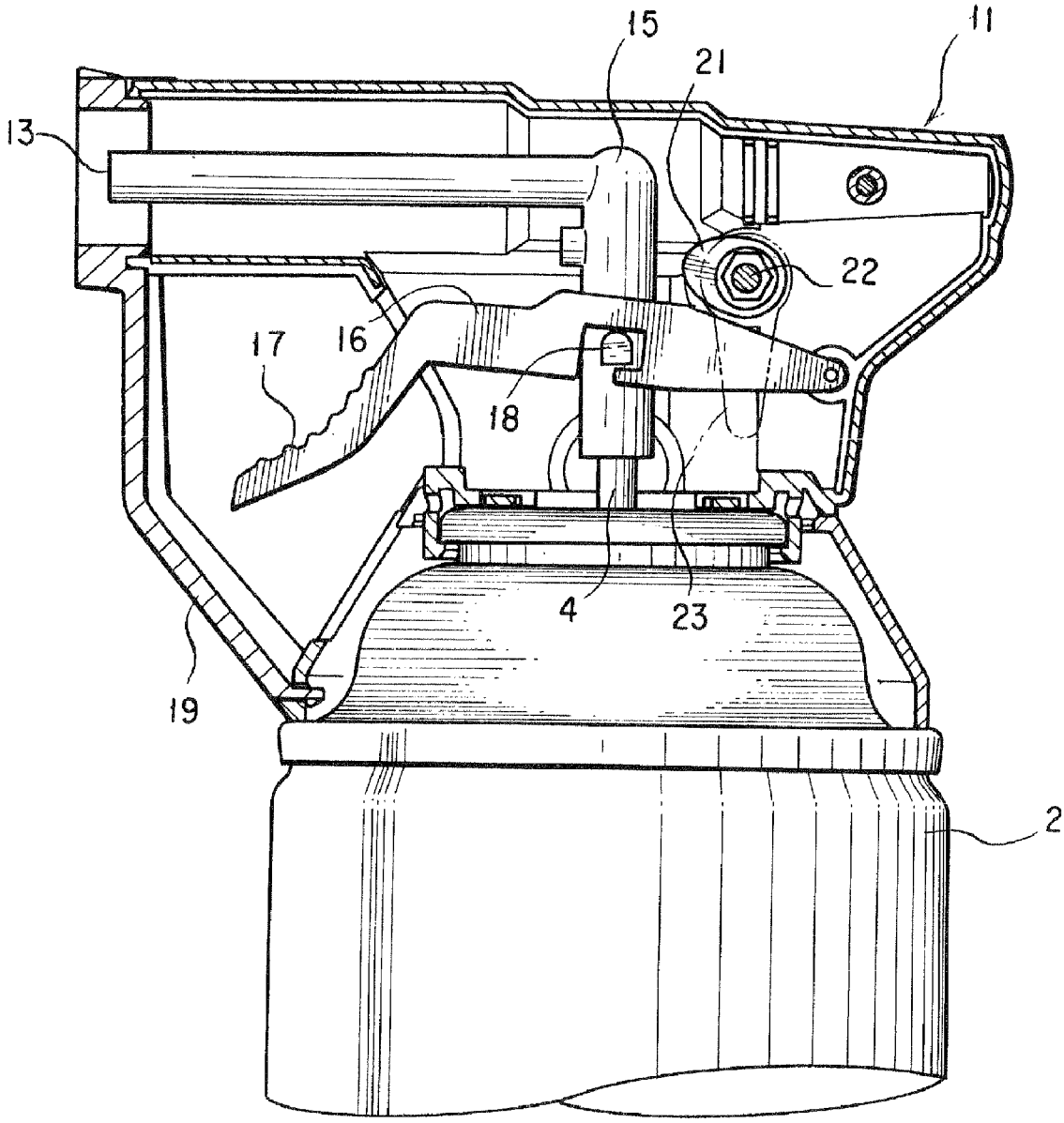
FIG. 4 is an explanatory view illustrating in cross section a part of the trigger type head cap for the aerosol sprayer.
Figure 5:
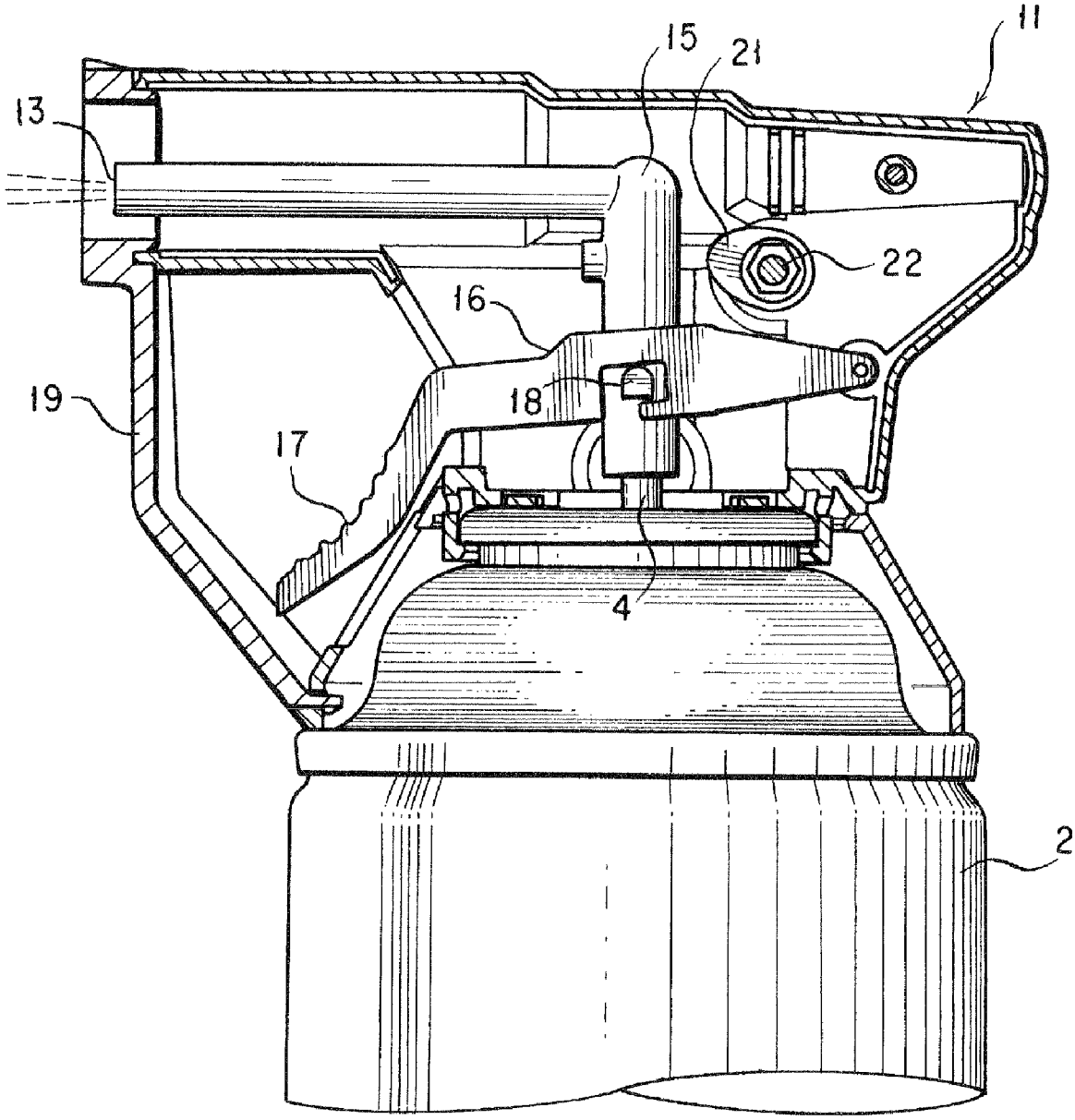
FIG. 5 is an explanatory view illustrating in cross section such a part of the trigger type head cap for the aerosol sprayer.

And, as shown in FIG. 4 the trigger lever member 16 is pivotally coupled at its rear end to the cap cover 11 so as to be made turntable vertically. It also is slidably engaged in its mid portion with two protrusions 18 formed on both sides of the tubular member 15 so that it may slide back and forth on these protrusions 18. Thus, turning the trigger lever member 16 downwards by pulling the trigger part 17 of the trigger lever member 16 as shown in FIG. 5 causes the tubular member 15, and the stem mating part 12 in the tubular member 15, to be thrust down, via the projections 18 on the tubular member 15.

Also, the cap cover 11 has at its front a guard member 19 which lies positioned ahead of the trigger part 17 of the trigger lever member 16 to guard the trigger part 17 of the trigger lever member 16.

In such makeup, pulling the trigger part 17 of the trigger lever member 16 thrusts down the tubular member 15, thrusting down the stem mating part 12 of the tubular member 15. This causes the stem 4 on the aerosol container 2 to be thrust down, allowing the content of the aerosol container 2 in its inside to spurt out or flush through the stem 4 and the flushed content to pass along the flow path 14 in the tubular member 15 and then to be sprayed forwards from the jet orifice 13.

And, the trigger type head cap for an aerosol sprayer is here equipped with a rotatable rotary stopper 21 for holding the stem mating part 12 of the tubular member 15 in the state that it is thrust down. The rotary stopper 21 is oval in shape, acting as a cam, and is rotatably mounted on the cap cover 11 via a transverse shaft 22 oriented right and left, and by being pushed against an upper surface of the trigger lever member 16, holds the stem mating part 12 of the tubular member 15 in the state that it is thrust down.

Further, a stopper operating lever 23 for effecting a rotation of the rotary stopper 21 is mounted on one side surface of the cap cover 11 and fastened to an end of the transverse shaft 22 of the rotary stopper 21. It should here be noted for completeness that the stopper operating lever 23 is positioned on the cap cover 11 rearwards of and opposite to the trigger part 17 of the trigger lever member 16 so that the stopper operating lever 23 and the trigger part 17 of the trigger lever member 16 are spaced away from each other.

Figure 6:
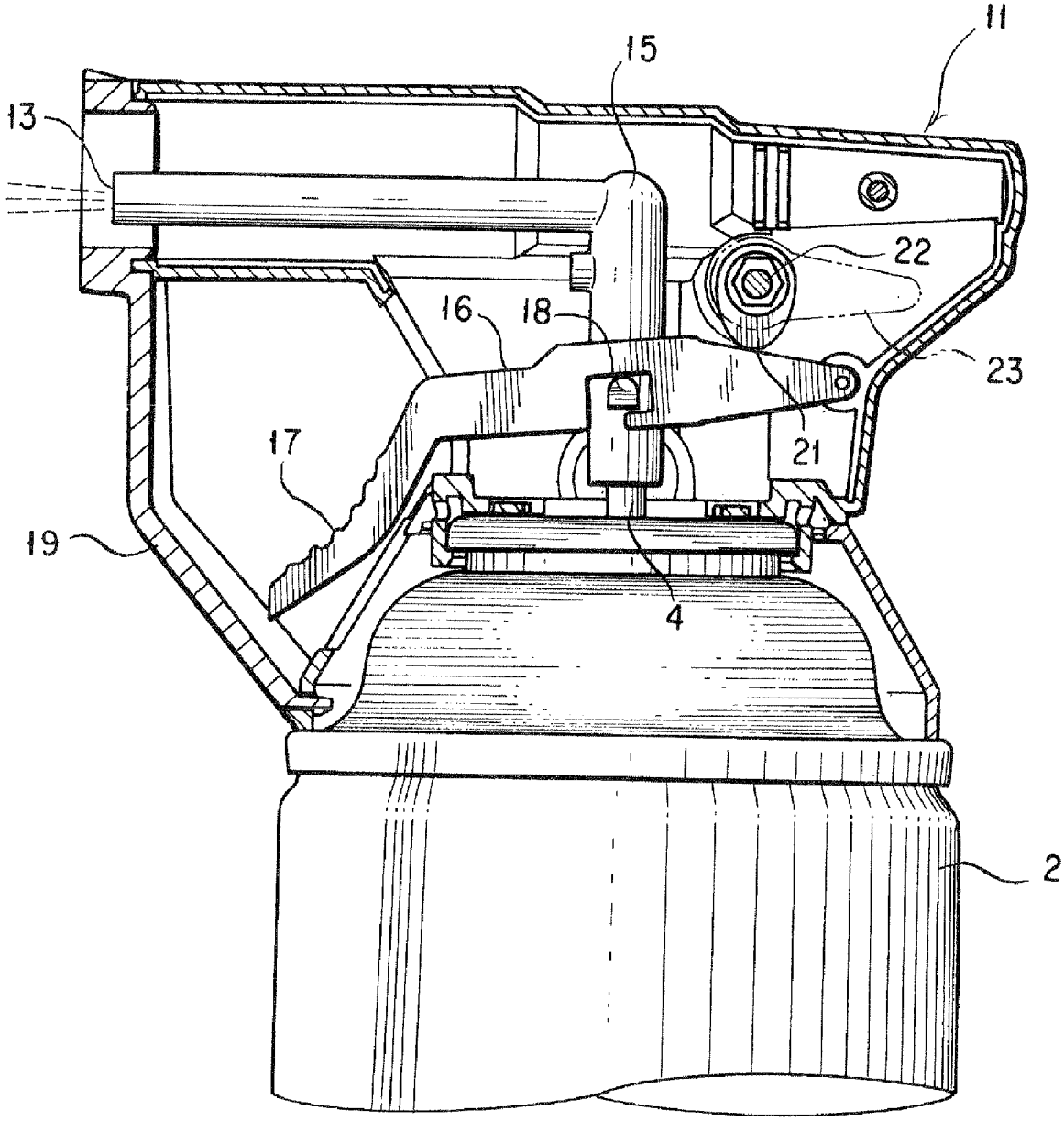
FIG. 6 is an explanatory view illustrating in cross section such a part of the trigger type head cap for the aerosol sprayer.

And, in such makeup, in the state that as shown in FIG. 5 the trigger part 17 of the trigger lever member 16 is pulled whereby the stem 4 on the aerosol container 2 is thrust down and the content of the aerosol container 2 in its inside is thus sprayed, the stopper operating lever 23 is then turned as shown in FIG. 6. This causes the rotary stopper 21 to rotate, bearing down on the upper surface of the trigger lever member 16. The trigger lever member 16 is thus locked by the rotary stopper 21, holding the stem mating part 12 of the tubular member 15 in the state that it is thrust down, thus holding the sprayer in the state of spraying.

Figure 7:
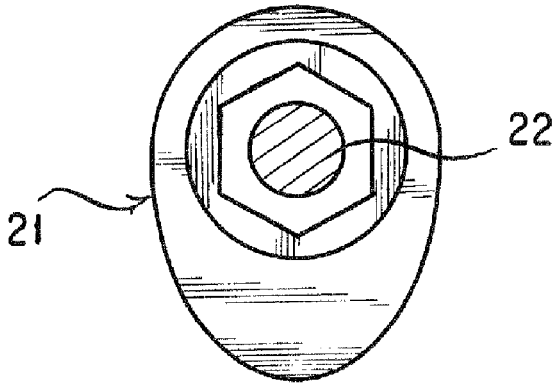
FIG. 7 is an explanatory view of a rotary stopper.
Figure 8:
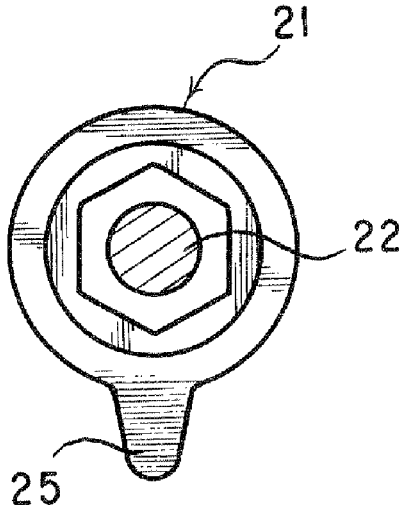
FIG. 8 is an explanatory view of a rotary stopper different in shape.
Figure 9:
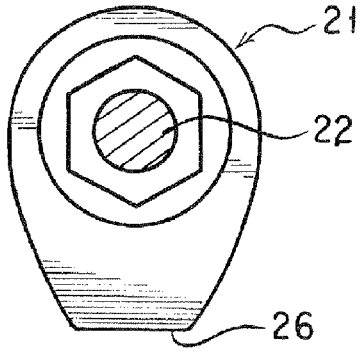
FIG. 9 is an explanatory view of a rotary stopper different in shape.
Figure 10:
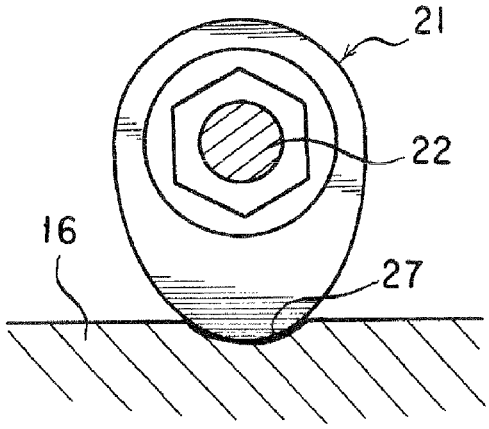
FIG. 10 is an explanatory view of a rotary stopper different in shape.
Figure 11:
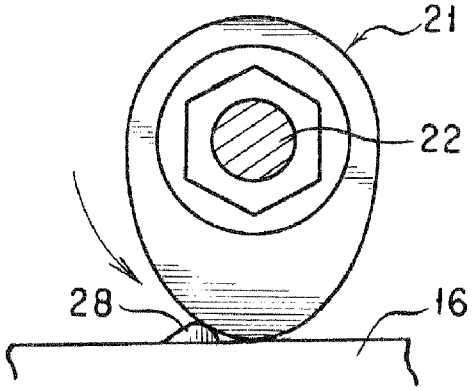
FIG. 11 is an explanatory view of a rotary stopper different in shape.

Apropos, the rotary stopper 21 is not limited to what is oval in shape acting as a cam as shown in FIG. 7. For example, it may be in the form of a discus with a projection 25 as shown in FIG. 8, or may be triangular or polygonal in shape, and may be of any shape whatsoever if it has the same function as of what is oval in shape acting as a cam. Taking into account such as its operability when it is rotated, however, the rotary stopper 21 should preferably be oval in shape acting as a cam most smoothly rotating after all. In the case of a rotary stopper 21 which is oval in shape acting as a cam as shown in FIG. 7, it may as shown in FIG. 9 have at its lower end a flat surface portion 26 which can be pressed on an upper surface of the trigger lever member 16, and alternatively the trigger lever member 16 may as shown in FIG. 10 be formed in its upper surface with a recess 27 such as to fit with a lower end of the rotary stopper 21. Alternatively, the trigger lever member 16 may as shown in FIG. 11 be formed in the upper surface with a raised projection 28 by which the rotary stopper 21 may be caught at its lower end. This makes it possible that while the stem mating part 12 in the tubular member 15 is being locked by the rotary stopper 21 in the state that it is thrust down (i.e., in the spraying state), it cannot readily be released from its locking. This in turn makes it possible, if there is some external acting force, to hold the thrusting state reliably and thus to discharge and eliminate the residual gas in the aerosol container 2 very well.

Further, the means for effecting a rotation of the rotary stopper 21 is shown comprising the stopper operating lever 23 in the form of a lever in the form of implementation mentioned above, but not limited so. The means for effecting a rotation of the rotary stopper 21 nay, for example, be a disk-shaped knob peripherally knurled in an alternative form of implementation and may be implemented in a form in which a knurl is attached to an end of the transverse shaft 22 of the rotary stopper 21, i.e., may make use of the transverse shaft 22 of the rotary stopper 21 as it is. It is most preferable, however, to use a form of the lever after all, taking it into account that it can effect a rotation of the rotary stopper 21 easily.

Further, the position of disposition of the rotary stopper 21 and the stopper operating lever 23 is not limited to that which is on the cap cover 11 rearward of and opposite to the trigger part 17 of the trigger lever member 16 and may be elsewhere. As to this, for example, the rotary stopper 21 may be positioned ahead of the trigger lever member 16, i.e., on the upper side of a root portion of the trigger part 17 of the trigger lever member 16, and the stopper operating lever 23 on one side of thereof. Further, while the rotary stopper 21 is shown arranged to bear down on an upper surface of the trigger lever member 16, thus to hold, via the trigger lever member 16, the stem mating part 12 of the tubular member 15 in the state that it is thrust down, the rotary stopper 21 may instead be disposed on the upper side of the tubular member 15 to bear down on an upper surface of the tubular member 15 without intermediary of the trigger lever member 16.

Also, while in the form of implementation mentioned above, the tubular member 15 and the trigger lever member 16 are shown made as separate members which are engaged with each other, the tubular member 15 and the trigger lever member 16 may be unified, i.e., made of a single member.

Next, mention is made of an operation to discharge and eliminate a residual gas inside of the aerosol container 2 in the aerosol sprayer 1 when an entire content of the aerosol container 2 therein has been sprayed out and used up (at the end of use of the aerosol sprayer 1). As shown in FIG. 5, the trigger part 17 of the trigger lever member 16 is pulled to thrust down the stem 4 on the aerosol container 2, bringing about a state of spraying in which the content of the aerosol container 2 inside thereof is sprayed. And, by turning the stopper operating lever 23 in this spraying state as shown in FIG. 6 to rotate the rotary stopper 21, the rotary stopper 21 bear down on the upper surface of the trigger lever member 16 to lock the trigger lever member 16, thereby holding the stem mating part 12 of the tubular member 15 in the spraying state as it is thrust down. This keeps the aerosol sprayer 1 in the spraying state, allowing the residual gas inside of the aerosol container 2 to be discharged completely to the end.

While in the residual gas discharging and eliminating operation mentioned above, the trigger part 17 of the trigger lever member 16 is beforehand pulled to bring about the spraying state whereafter the stopper operating lever 23 is turned to lock the trigger lever member 16 with the rotary stopper 21, it may be noted that by turning the stopper operating lever 23 right out on without pulling the trigger part 17 of the trigger lever member 16, the trigger lever member 16 may be turned downwards and locked with the rotary stopper 21, thereby holding the state of spraying.

As mentioned above, by providing a rotatable rotary stopper 21 capable of holding a stem mating part 12 of a tubular member 15 in the state that it is thrust down, in an operation to discharge and eliminate a residual gas inside of an aerosol container 2 in an aerosol sprayer 1 it is possible to accomplish discharging and eliminating the residual gas in an extremely simple and plain operation that is merely by rotation of the rotary stopper 21.

Further, by providing a stopper operating lever 23 on a side surface of the cap cover 11 for effecting a rotation of the rotary stopper 21 it is possible to effect the rotation of the rotary stopper 21 in an extremely simple and plain operation that is merely by turning the stopper operating lever 23.

Also, by providing the stopper operating lever 23 at a position on the cap cover 11 rearward of and opposite to the trigger part 17 of the trigger lever member 16 to make the stopper operating lever 23 and the trigger part 17 of the trigger lever member 16 spaced apart from each other, i.e., by positioning the trigger part 17 of the trigger lever member 16 frontwards on the cap cover 11 and the stopper operating lever 23 backwards on the cap cover 11 so that they are spaced apart from each other, it is possible to effectively prevent the stopper operating lever 23 from being wrongly operated when the trigger part 17 of the trigger lever member 16 is pulled for normal spraying.

What is claimed is:

1. A trigger type head cap for an aerosol sprayer that has an aerosol container with a stem provided on top of the aerosol container, the trigger type head cap comprising:

a cap cover adapted to be fitted on the aerosol container of the aerosol sprayer;

a tubular member that comprises a stem mating part which is adapted to mate with the stem on the aerosol container in the cap cover, and ends with a jet orifice, to form a flow path that is continuous from the stem mating part to the jet orifice in the tubular member;

a trigger lever member capable of thrusting down the stem mating part of the tubular member in the cap cover; and a rotatable rotary stopper which acts as a cam and is capable of being pushed against an upper surface of the trigger lever member to hold the stem mating part of the tubular member in a state in which the stem mating part is thrust down;

wherein the rotary stopper is substantially oval-shaped with a flat surface portion at a lower end thereof such that the flat surface portion can be pressed on the upper surface of the trigger lever member.

2. A trigger type head cap for an aerosol sprayer as set forth in claim 1, further comprising a stopper operating lever on a side surface of the cap cover for effecting rotation of the rotary stopper.

3. A trigger type head cap for an aerosol sprayer as set forth in claim 2, wherein the stopper operating lever is positioned on the cap cover at an opposite side from a trigger part of the trigger lever member so that the stopper operating lever and the trigger part of the trigger lever member are spaced away from each other.

4. A trigger type head cap for an aerosol sprayer that has an aerosol container with a stem provided on top of the aerosol container, the trigger type head cap comprising:

a cap cover adapted to be fitted on the aerosol container of the aerosol sprayer;

a tubular member that comprises a stem mating part which is adapted to mate with the stem on the aerosol container in the cap cover, and ends with a jet orifice, to form a flow path that is continuous from the stem mating part to the jet orifice in the tubular member;

a trigger lever member capable of thrusting down the stem mating part of the tubular member in the cap cover; and a rotatable rotary stopper which acts as a cam and is capable of being pushed against an upper surface of the trigger lever member to hold the stem mating part of the tubular member in a state in which the stem mating part is thrust down;

wherein the rotary stopper is substantially oval-shaped and a recess is formed in the upper surface of the trigger lever member to fit with a lower end of the rotary stopper.

5. A trigger type head cap for an aerosol sprayer as set forth in claim 4, further comprising a stopper operating lever on a side surface of the cap cover for effecting rotation of the rotary stopper.

6. A trigger type head cap for an aerosol sprayer as set forth in claim 5, wherein the stopper operating lever is positioned on the cap cover at an opposite side from a trigger part of the trigger lever member so that the stopper operating lever and the trigger part of the trigger lever member are spaced away from each other.

7. A trigger type head cap for an aerosol sprayer that has an aerosol container with a stem provided on top of the aerosol container, the trigger type head cap comprising:

a cap cover adapted to be fitted on the aerosol container of the aerosol sprayer;

a tubular member that comprises a stem mating part which is adapted to mate with the stem on the aerosol container in the cap cover, and ends with a jet orifice, to form a flow path that is continuous from the stem mating part to the jet orifice in the tubular member;

a trigger lever member capable of thrusting down the stem mating part of the tubular member in the cap cover; and a rotatable rotary stopper which acts as a cam and is capable of being pushed against an upper surface of the trigger lever member to hold the stem mating part of the tubular member in a state in which the stem mating part is thrust down;

wherein the rotary stopper is substantially oval-shaped and a raised projection is provided on the upper surface of the trigger lever member to catch a lower end of the rotary stopper.

8. A trigger type head cap for an aerosol sprayer as set forth in claim 7, further comprising a stopper operating lever on a side surface of the cap cover for effecting rotation of the rotary stopper.

9. A trigger type head cap for an aerosol sprayer as set forth in claim 8, wherein the stopper operating lever is positioned on the cap cover at an opposite side from a trigger part of the trigger lever member so that the stopper operating lever and the trigger part of the trigger lever member are spaced away from each other.

* * * * *